US008251177B2

(12) United States Patent
Watt

(10) Patent No.: US 8,251,177 B2
(45) Date of Patent: Aug. 28, 2012

(54) COLLAPSIBLE ACCESS TOWER

(75) Inventor: Alan Watt, Brentwood (GB)

(73) Assignee: Monkey Tower Limited, Essex (GB)

( * ) Notice: Subject to any disclaimer, the term of this patent is extended or adjusted under 35 U.S.C. 154(b) by 995 days.

(21) Appl. No.: 11/915,875

(22) PCT Filed: Jun. 2, 2006

(86) PCT No.: PCT/GB2006/050138

§ 371 (c)(1),
(2), (4) Date: Nov. 29, 2007

(87) PCT Pub. No.: WO2006/129129

PCT Pub. Date: Dec. 7, 2006

(65) Prior Publication Data

US 2008/0196977 A1 Aug. 21, 2008

(30) Foreign Application Priority Data

Jun. 3, 2005 (GB) ..... 0511249.5
Nov. 1, 2005 (GB) ..... 0522194.0

(51) Int. Cl.
*E04G 1/22* (2006.01)

(52) U.S. Cl. ..... 182/69.6; 182/63.4; 182/64.1; 182/66.1; 182/68.1; 182/69.4; 182/141

(58) Field of Classification Search ..... 182/63.1, 182/64.1, 66.1, 68.1, 69.4, 69.6, 141
See application file for complete search history.

(56) References Cited

U.S. PATENT DOCUMENTS

| | | | | | |
|---|---|---|---|---|---|
| 93,877 | A | * | 8/1869 | Haasz | 182/130 |
| 470,112 | A | * | 3/1892 | Ehrentraut | 182/18 |
| 3,454,131 | A | * | 7/1969 | Johnson et al. | 182/115 |
| 3,464,519 | A | | 9/1969 | Whisler | |
| 3,871,478 | A | * | 3/1975 | Bushnell, Jr. | 182/69.4 |
| 3,882,964 | A | * | 5/1975 | Schellenberg | 182/69.4 |
| 3,889,778 | A | | 6/1975 | Dotts | |
| 4,390,080 | A | * | 6/1983 | Bushnell, Jr. | 182/115 |
| 4,619,346 | A | | 10/1986 | Deguerry | |
| 4,657,113 | A | * | 4/1987 | Costello | 182/63.1 |
| 4,967,733 | A | * | 11/1990 | Rousseau | 182/13 |
| 5,111,907 | A | * | 5/1992 | Kishi | 182/69.4 |
| 5,850,892 | A | | 12/1998 | Citron et al. | |

FOREIGN PATENT DOCUMENTS

| | | |
|---|---|---|
| GB | 2067513 | 7/1981 |
| JP | 03172461 | 7/1991 |

* cited by examiner

*Primary Examiner* — Alvin Chin Shue
*Assistant Examiner* — Colleen M Chavchavadze
(74) *Attorney, Agent, or Firm* — Andrus, Sceales, Starke & Sawall, LLP

(57) ABSTRACT

A collapsible access tower has a chassis 10 supporting a pair of road wheels 11 and outriggers 16,17 to impart stability when in use, and a pair of extensible multi-section columns 26,50 carrying a platform 35. A section 27 of one column 26 is rigidly connected to the chassis and another section 33 of that column to the platform 35. The other column is configured as an extendible ladder 50 one section 51 of which is hinged to the chassis 10 and another section 52 of which is hinged to the platform 35. When the platform is in its lowermost setting, the hinged connections of the two sections 51,52 of the ladder 50 are co-axial so that the ladder may be pivoted to a transit setting. A winch arrangement 39 is associated with column 26 to allow raising and lowering of the platform 35.

20 Claims, 16 Drawing Sheets

COLLAPSIBLE ACCESS TOWER

CROSS REFERENCE TO RELATED APPLICATION

The present application is the U.S. national stage application of International Application PCT/GB2006/050138, filed Jun. 2, 2006, which international application was published on Dec. 7, 2006 as International Publication WO 06/129129. The International Application claims priority of British Patent Application 0511249.5, filed Jun. 3, 2005 and British Patent Application 0522194.0 filed Nov. 1, 2005.

This invention relates to a collapsible access tower, and in particular to such a tower which is able to give elevated access for example to a building, but which may rapidly be collapsed for transport from place to place.

Scaffold towers are widely used to give temporary elevated access for example to the exterior or even the interior of buildings, without the need to erect full conventional scaffolding, with all of the attendant costs associated with that. Typically, a scaffold tower has a number of similar planar frames which may be assembled together to provide a generally rectangular (in horizontal cross-section) tower. When erected to the required height, a platform is provided on the upper sections of the tower and an external ladder used to gain access to that platform.

Mobile elevating work platforms are also known, for example from U.S. Pat. No. 5,850,892 and GB-2067513. These comprise a wheeled chassis supporting a complex hydraulic mechanism adapted to raise or lower a personnel platform. Stabilisers for the chassis may be deployed to impart stability to the structure, when not being move from place to place.

An improved form of elevating work platform is described in U.S. Pat. No. 4,619,346 and comprises a pair of multi-section columns between which is mounted a platform. The platform is raised by extending the columns and for transit, the columns are collapsed and then folded to lie generally horizontally, side-by-side. The arrangement of U.S. Pat. No. 4,619,346 has the disadvantage that a complex connection has to be provided between the platform and the columns in order to allow folding of the columns to their transit position. Either the platform has to be disconnected from the columns, and then reconnected to allow use, or a sliding connection must be provided to allow the columns to be folded. In either case, there are complex latch mechanisms in order to ensure adequate safety in use. Further problems associated with this platform are that in view of the weight of the structure it is necessary to use a powered winch. Also, as there is no ladder provided or associated with the platform, work personnel have to be raised and lowered with the platform. This adds to the safety requirements as well as extending the time for completing works, in view of the number of times the platform has to be raised and lowered, both of which have cost implications.

It is a principal aim of the present invention to provide a collapsible access tower which obviates the disadvantages mentioned above particularly in relation to a tower such as that described in U.S. Pat. No. 4,619,346.

Accordingly, this invention provides a collapsible access tower comprising a base, first and second extensible members mounted on the base and each extendible from a contracted setting to a raised setting, the first extensible member being fixedly mounted on the base to project upwardly therefrom and the second extensible member being pivoted to the base at a location spaced from the mounting of the first member and being arranged for pivoting movement between an erect position where the second member also projects upwardly and a transit position, and a support secured to the first member and pivoted to the second member about an axis which is substantially coaxial with the pivotal connection of the second member to the base when the first and second members are in their respective contracted settings.

With the access tower of this invention, the support remains connected to the first and second extensible members both when the tower is in use to give elevated access, and when the members are in their contracted settings with the second member pivoted to its contracted setting. This is achieved by having the pivotal axis of the second extensible member about which the member pivots with respect to the chassis coaxial with the pivotal axis of the second extensible member to the platform, when the second member is in its contracted setting. By not having a releasable connection, greater reliability and safety can be assured at a lower cost.

Most preferably, each extensible member comprises a plurality of sections connected together for relative sliding movement along the length of the member. The first extensible member may have a first section rigidly mounted to the base, a second section rigidly connected to the support and at least one intermediate section which is slidably linked to the sections to each side thereof. In a preferred embodiment, two such intermediate sections are provided, to give a sufficient extended length for the member when elevated access is required. The sections may be interlinked by providing grooves along the length of each section, which grooves are engaged by flanges provided on the adjacent section whereby the sections may slide relatively and remain interlinked. Rollers or other friction-reducing elements may be provided in the sliding connections between the sections.

A hoist may be associated with the first extensible member in order to effect extension thereof, and also to control contraction thereof. Such a hoist may comprise a winch assembly mounted on the first section of the first member or on the base itself, a flexible tension member (such as a wire cable or chain) running from the winch assembly over a pulley at the upper end of the first section and arranged to raise the adjacent intermediate section. This may be achieved by running the tension member around a pulley at the lower end region of the adjacent intermediate section, then over a further pulley at the upper end of that intermediate section and then to the next adjacent section. By repeating this for each intermediate section and securing the end of the tension member to the second section (rigidly connected to the support), all of the sections may slide simultaneously or sequentially with operation of the winch, thereby to extend the first extensible member. Conversely, paying out the tension member from the winch will allow the sections to contract.

As an alternative, a number of separate flexible tension members may be employed, one for each section of the first extensible member. The tension member from the winch may be secured to the lower end region of the adjacent intermediate section. A further tension member may then extend from that intermediate section over a pulley at the upper end thereof and then to the next adjacent section, to be secured to the lower end thereof. This may be repeated for as many sections as are included in the first extensible member. This arrangement ensures all the sections slide simultaneously as the winch is operated.

As an alternative to a winch arrangement as described above, it would be possible to provide some other arrangement for controlling extension and contraction of the first extensible member, such as an hydraulic ram or rams, or a rack and pinion arrangement.

The second extensible member may comprise a first section pivoted about a transverse axis to the base, a second section pivotally connected to the support and at least one intermediate section slidably linked to the sections at each side thereof. In a preferred embodiment, there is one such intermediate section slidably linked on one of its sides to the first section and on its opposed side to the second section. The second section may include a latch arrangement adapted to connect to a part of the support (such as a guard rail therearound) to assist retention of the second extensible member in its erected position before raising the support.

The second extensible member advantageously comprises a pair of rails with cross members extending rigidly therebetween, at an appropriate spacing such that the second member may serve as a ladder to give access to the support, when raised. For such an arrangement, it is preferred for an automatically-operating lock mechanism to act on the cross members, so as to restrict contracting movement of the second extensible member until released. Such a lock mechanism may automatically operate to lock contracting movement once the second member has been extended, but then may be released by extending the second member yet further, whereafter contracting movement is permitted.

Other lock arrangements may be provided either instead of or in addition to that described above. For example, a manually-releasable lock mechanism may be provided on the first extensible member and which must be released before the first member may be contracted, following the extension thereof.

The support may take the form of a platform on which an operator may stand, or could be a simple framework on which a suitable support surface may be placed. In the latter case, a support surface could be assembled from scaffold boards cut to a suitable length.

Though an access tower with two extensible members has been described, it would of course be possible to use more than two—for example with two opposed second members, one to each side of the support.

Conveniently, the base is arranged as a wheeled chassis to permit ready transport of the tower. The chassis may take the form of a single-axle trailer for towing behind a vehicle. The track of the wheels may be adjusted between a wide setting for use when the chassis is to be towed and a narrow setting to facilitate maneuvering of the chassis on-site, or perhaps through a doorway. Further, the chassis may have extendable outriggers each furnished with a screw-threaded ground jack whereby stability of the chassis may be enhanced, when the tower is in use.

By way of example only, one specific embodiment of collapsible access tower of this invention will now be described in detail, reference being made to the accompanying drawings in which:—

Figure 1:
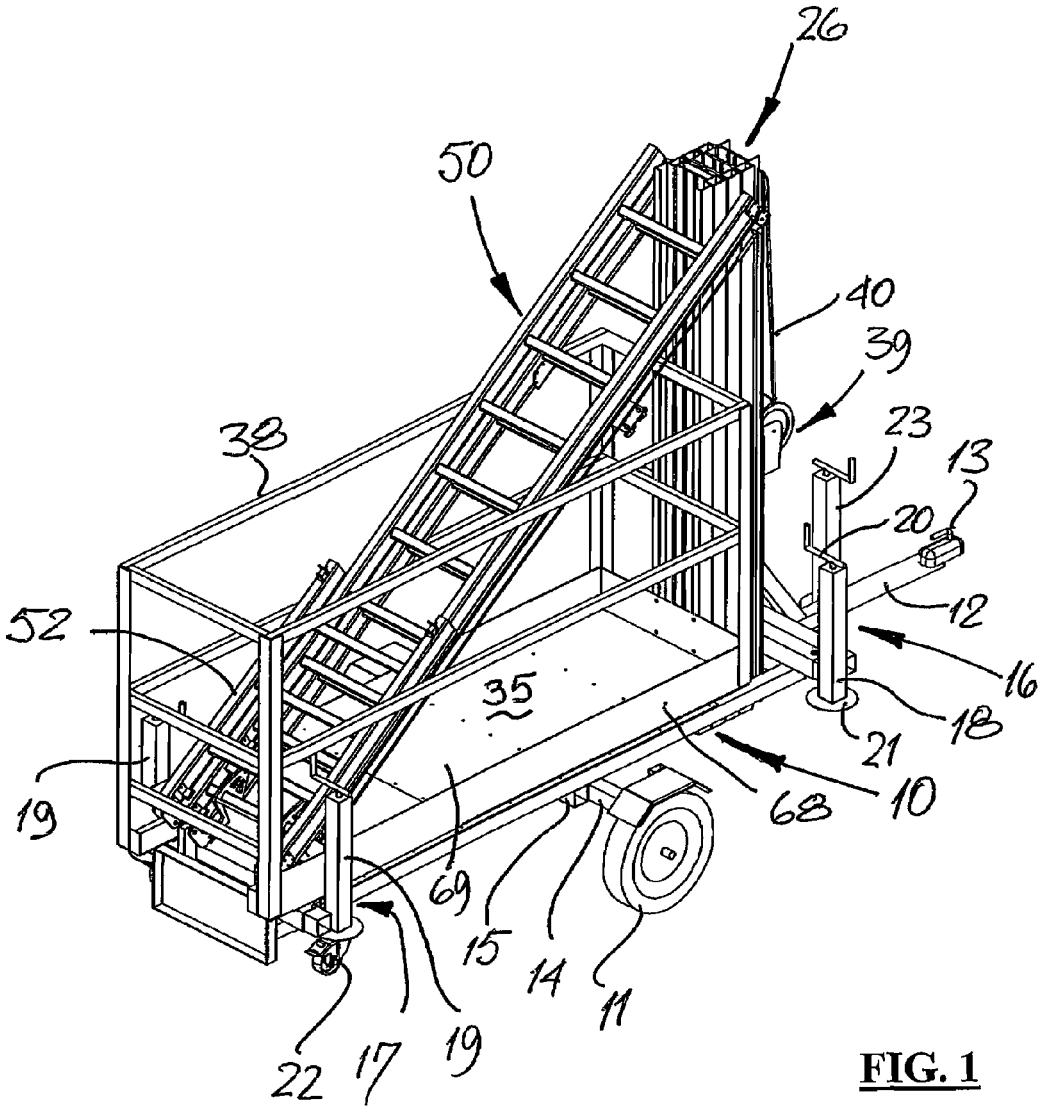
FIG. 1 is a general isometric view of the access tower in a fully collapsed transit state.
Figure 2:
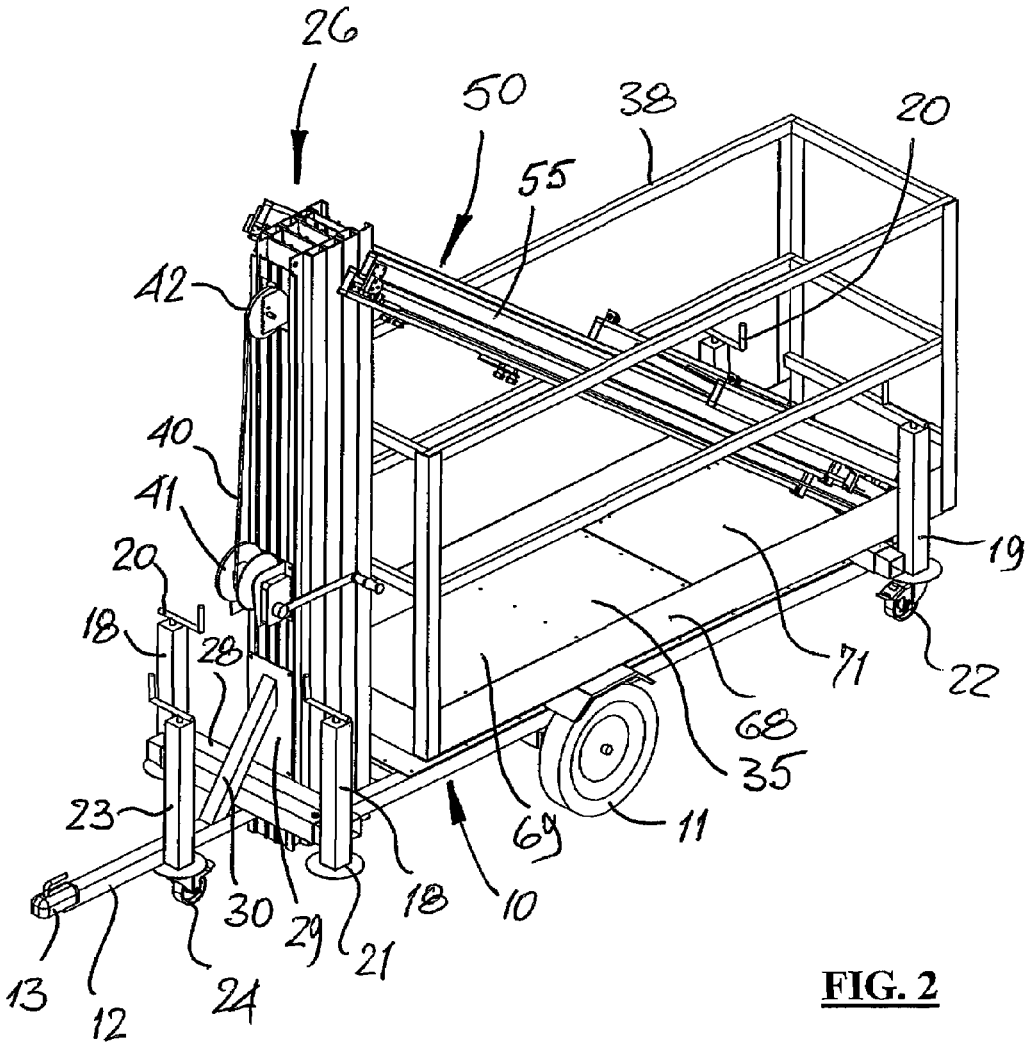
FIG. 2 is a view similar to that of FIG. 1, but from the opposed end of the tower.

Referring initially to FIGS. 1 to 5, there is shown the embodiment of access tower of this invention, FIG. 1 showing that tower ready for towing as a trailer behind a vehicle and FIG. 2 showing the tower being prepared for use. The tower comprises a chassis 10 supporting a pair of road wheels 11 (only one of which is visible in FIG. 1) and having a tow bar 12 fitted with a conventional ball hitch 13. Each road wheel is carried by a suspension unit (not shown) provided at the outer end of a box-section member 14 slidably mounted within a further member 15 forming a part of the chassis 10. The track of the wheels 11 may be decreased from that shown in FIG. 1 by releasing a lock (not shown) for the two box members 14 and then sliding the wheels towards each other, whereafter the lock may be re-engaged with the wheels at their narrower setting, as shown in FIGS. 2 to 5.

Figure 3:
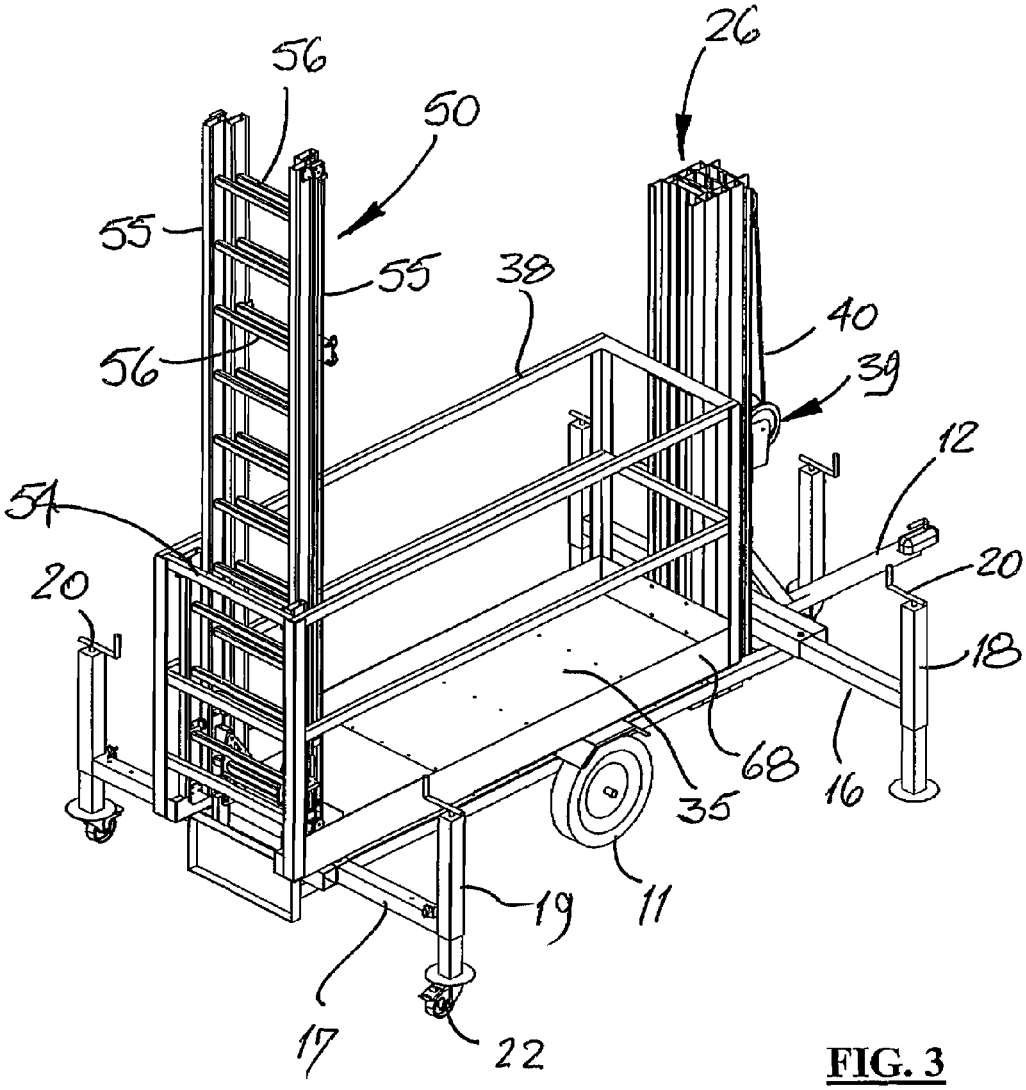
FIG. 3 is a view similar to FIG. 1, but with the ground-wheels and outriggers in alternative positions and the ladder raised.
Figure 4:
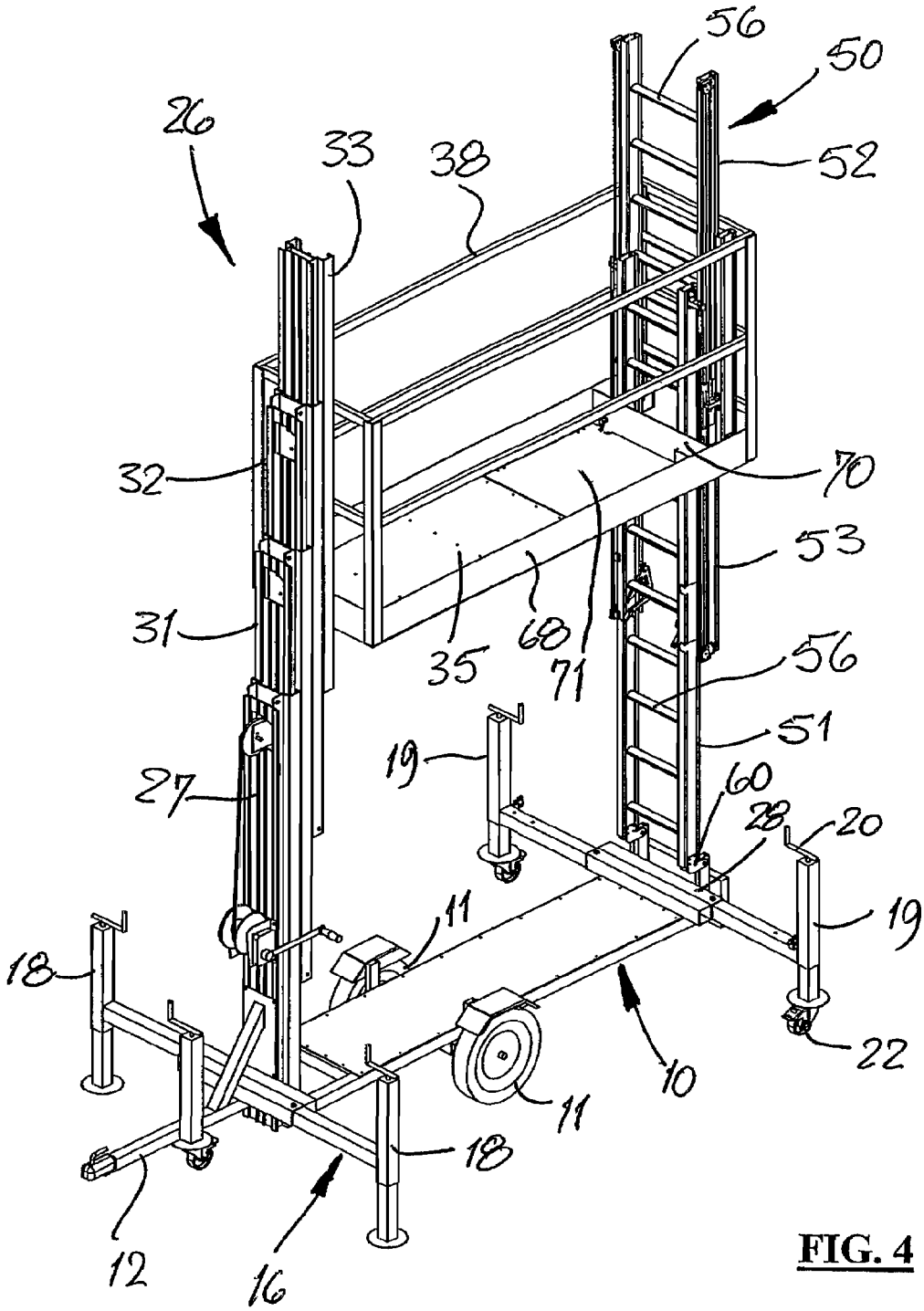
FIG. 4 shows the tower with the platform partly raised.
Figure 5:
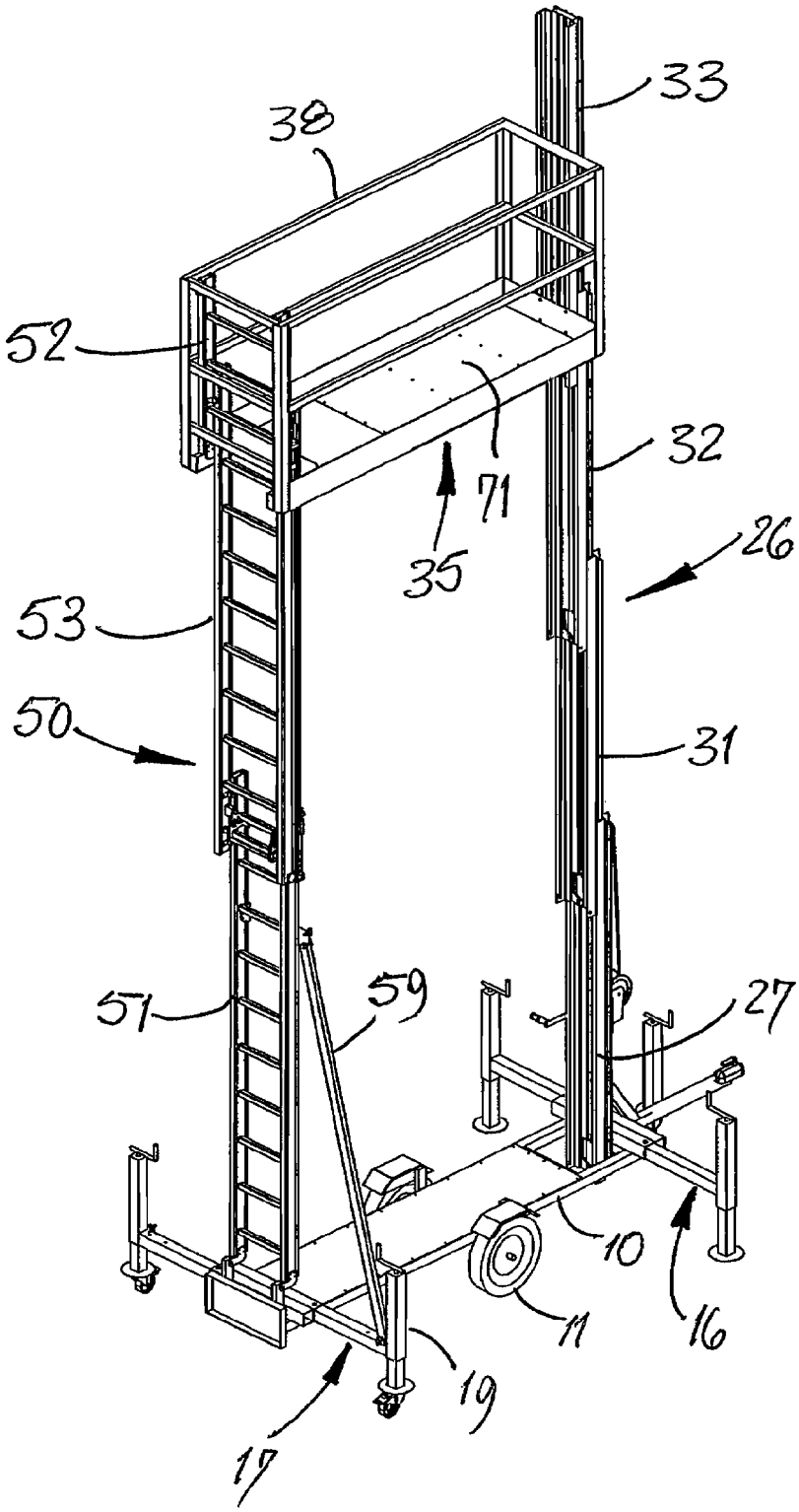
FIG. 5 is similar to FIG. 4 but with the platform fully raised.

The chassis includes a pair of forward outriggers 16 and a pair of rearward outriggers 17, each of which may be slid between a transport position shown in FIGS. 1 and 2 and an active position shown in FIGS. 3 to 5. Again, a lock (not shown) is provided to secure each outrigger in its chosen position. Each outrigger has a respective vertical screw-threaded jack 18,19 provided with an operating handle 20 at its upper end; each forward screw-threaded jack 18 has a simple foot 21 at its lower end whereas each rearward screw-threaded jack 19 has a castor wheel 22 at its lower end. A further screw-threaded jack 23 is provided on the tow bar 12 and this also has a castor wheel 24 at its lower end.

An extensible column 26 is provided at the forward end of the chassis 10, this column comprising a plurality of sections interlinked for relative sliding movement. The column comprises a first section 27 connected to a cross member 28 of the chassis and further supported by a plate 29 having a brace 30 connected to the tow bar 12. First intermediate section 31 is slidably connected to first section 27 by means of an in-turned flange on each side of the first section 27 slidably engaged in a corresponding groove in the first intermediate section, with rollers provided in the grooves to reduce friction. Similarly, second intermediate section 32 is slidably connected to the first intermediate section 31, and a second section 33 is slidably connected to the second intermediate section 32.

Figure 6A:
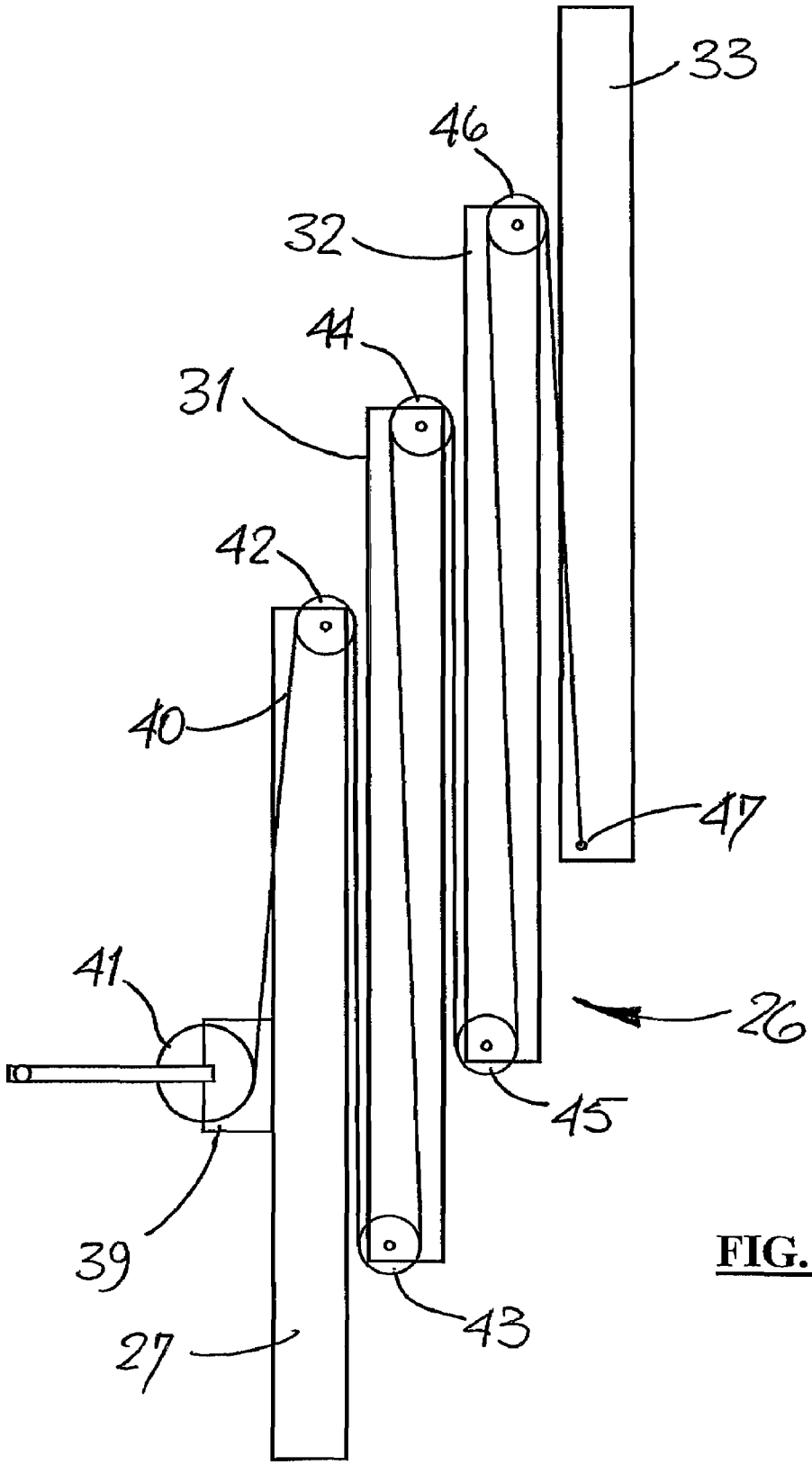
FIGS. 6A and 6B show alternative hoist arrangements for the main column.

A platform 35 in the form of a base panel 36, corner uprights 37 and guard rails 38 is rigidly connected to the second section 33 of the extensible column 26. Thus, extending the column 26 raises the platform 35. A winch 39 is provided for this purpose, the winch being mounted on the first section 27 and having a flexible steel cable 40 extending from the winch drum 41 around a pulley 42 provided at the upper end of the first section 27 of the extensible column 26—see FIG. 6A. From the upper end of the first section 27, the cable 40 passes around a pulley 43 at the lower end of the first intermediate section 31, then around a pulley 44 at the upper end of that intermediate section and similarly, around pulleys 45,46 on the second intermediate section 32, and is made fast at the lower end of the second section 33, at 47. In this way, winding cable on to the winch drum 41 will extend all of the sections so raising the column; conversely, paying out cable will allow all of the sections to contract. However, depending upon friction between the sections, all sections may move simultaneously or sequentially.

Figure 6B:
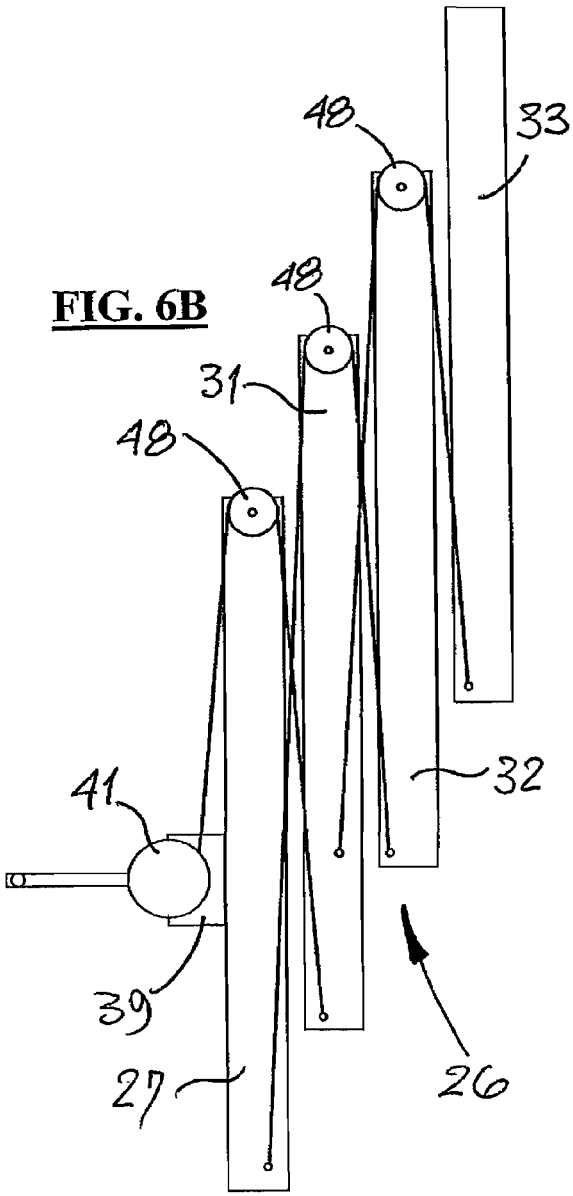

A slightly different and alternative cable arrangement is shown in FIG. 6B. Pulleys 48 are provided exclusively at the upper ends of the first section 27, first intermediate section 31 and second intermediate section 32. The cable 40 from the winch drum 41 passes around the pulley 48 at the upper end of the first section 27 and is made fast to the lower end of the first intermediate section 31. Two further but separate cables are provided, passing over the pulleys 48 at the upper ends of the two intermediate sections and with their ends made fast to the lower ends of the adjacent sections. Again, winding cable on to the winch drum 41 will extend all of the sections so raising the column, but with all of the sections moving simultaneously; conversely, paying out cable will allow all of the sections to contract simultaneously.

At the rearward end of the chassis 10 there is provided a ladder 50 having a first section 51 pivoted at its lower end to the chassis, a second section 52 pivoted at its lower end to the platform 35 and an intermediate section 53 slidably interconnected to both the first and second sections. In this way, the ladder 50 may be pivoted between the position shown in FIGS. 1 and 2, for transport, and the position shown in FIGS. 3 to 5, where the platform 35 is available for use. The upper end of the second section 52 is provided with catch arrangements 54 (see FIG. 12) for connecting to the guard rail 38 extending across the rear of the platform, merely to assist retention of the ladder in its erected position shown in FIG. 3 and so prevent the ladder falling to the position shown in FIG. 1 upon the ladder reaching its fully contracted position, or on moving the ladder from its folded position (FIGS. 1 and 2) to its erected position (FIG. 3).

Figure 7:
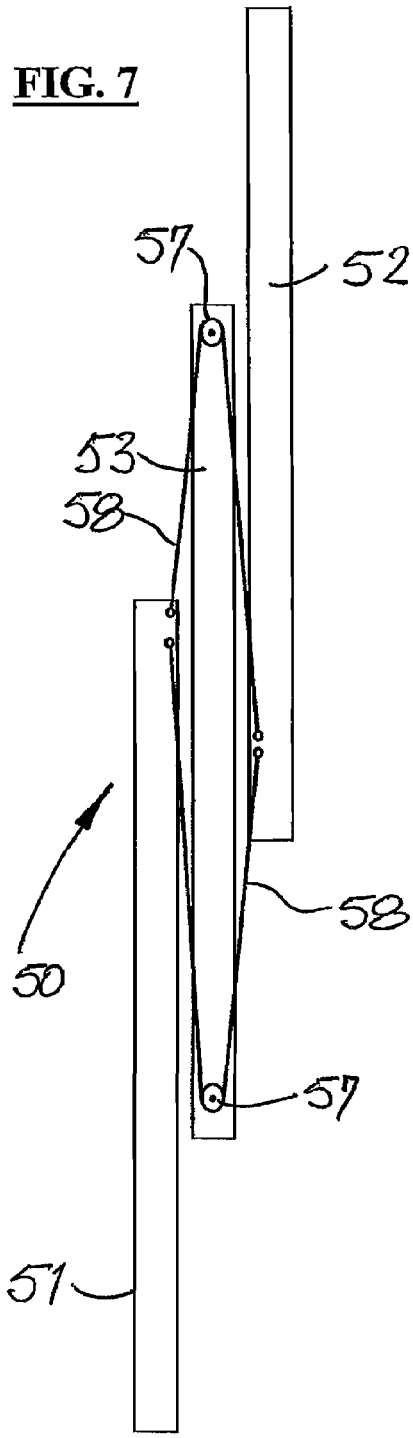
FIG. 7 shows the interconnection of the sections of the ladder.

Each section of the ladder comprises a pair of rails 55 between which extend rungs 56. Each section is linked to the next adjacent section by a sliding connection, as is conventionally used in the ladder art. Alongside the rails on one side of the ladder 50 (on the right-hand side as viewed in FIG. 1) there is provided the mechanism shown in FIG. 7, to ensure uniform extension of the ladder sections. This mechanism includes pulleys 57 adjacent the two ends of the intermediate section 53 and two flexible wire cables 58 which pass around those pulleys with the wire ends secured adjacent each other on the first and second sections respectively. Lifting of the second section on raising the platform 35 will cause the intermediate section 53 to move through half the distance moved by the second section.

Figure 8A:
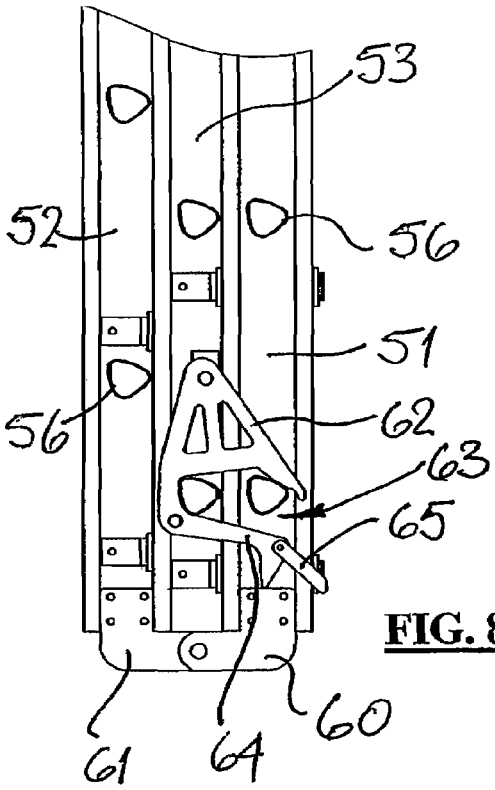
FIG. 8A shows the coaxial hinging axes of the ladder to the base and to the platform, respectively, as well as an automatic lock for the ladder.
Figure 9A:
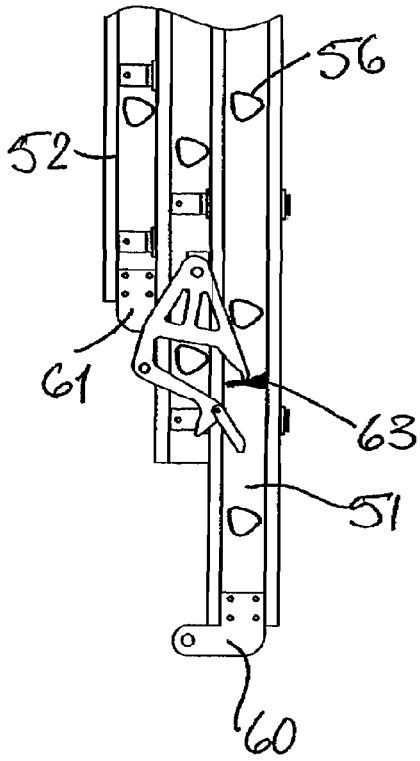
FIGS. 9A, 9B, 9C, 9D and 9E show successive steps of the operation of the automatic lock.
Figure 9B:
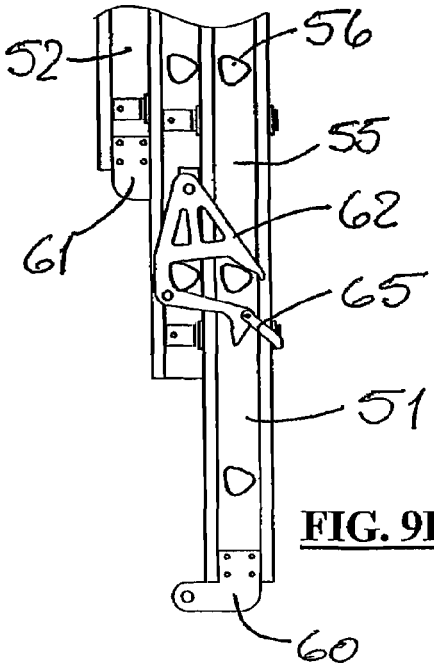
Figure 8B:
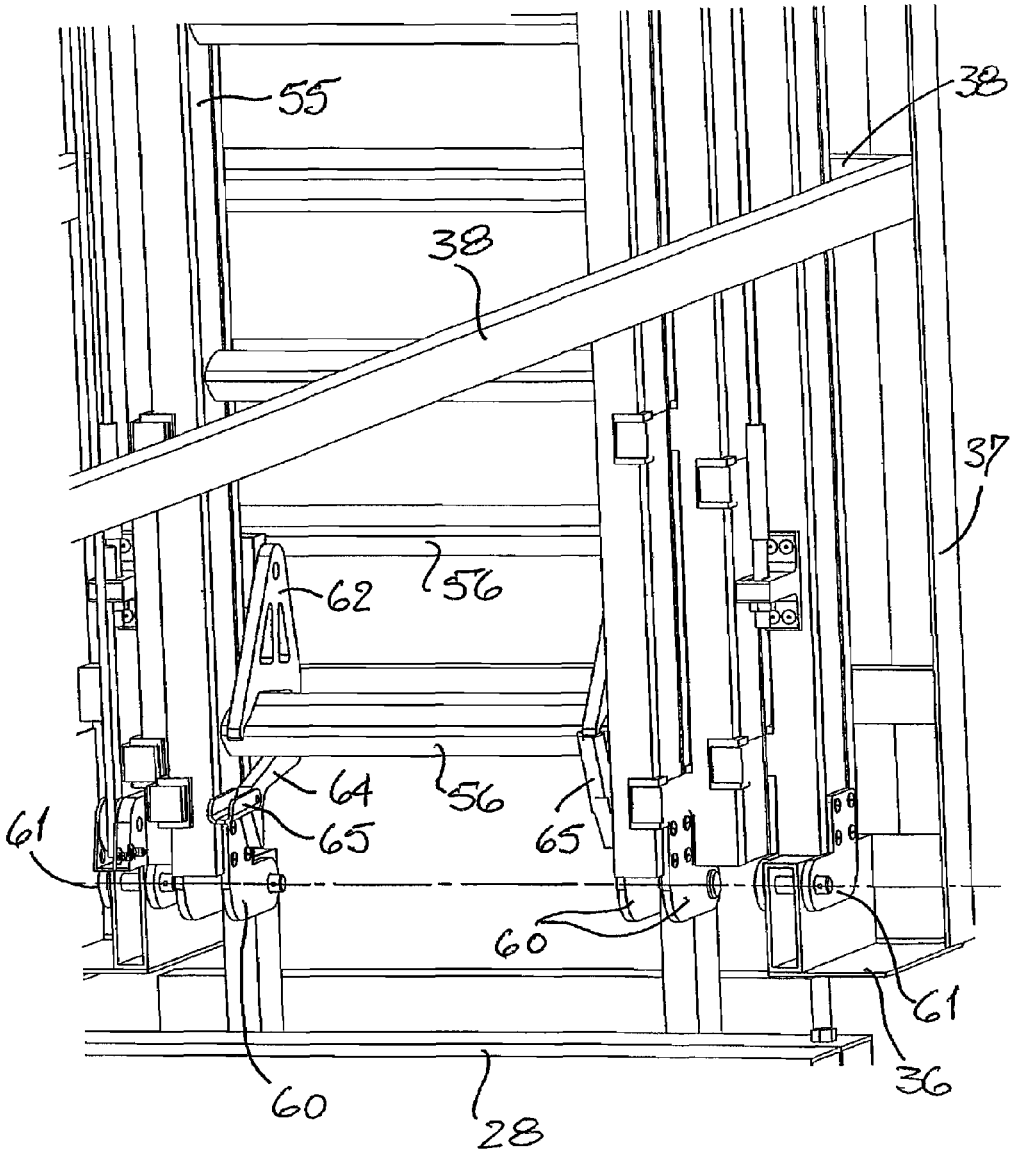
FIG. 8B is an isometric view of the lower region of the ladder and showing the coaxial hinging axes in greater detail.
Figure 9C:
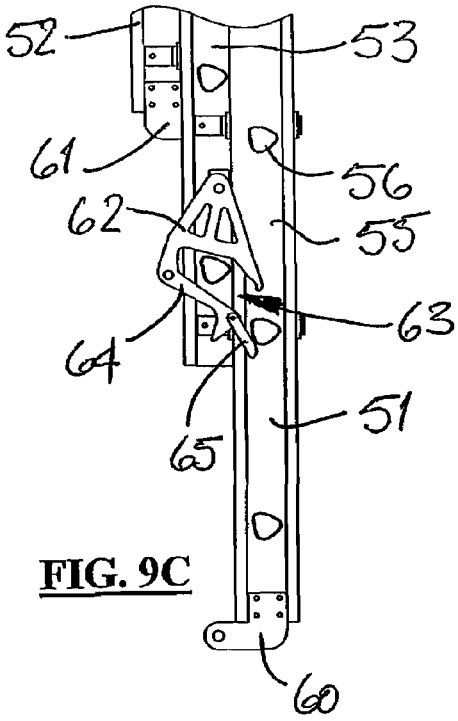
Figure 9D:
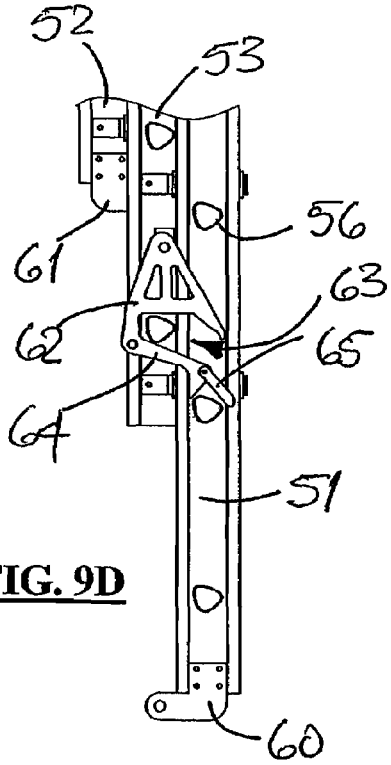
Figure 9E:
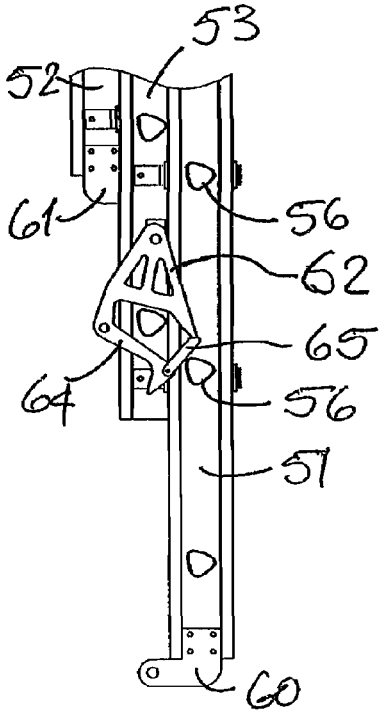

The lower ends of the first and second sections 51,52 of the ladder 50 are provided with respective lugs 60,61, these lugs being turned towards each other and with the lug 60 lying outboard of lug 61, on both sides of the ladder, as shown in FIGS. 8A and 8B. Lug 61 is hinged by a pin (not shown) to the platform 35 and lug 60 is hinged to the chassis 10 by means of a further pin (also not shown). With the ladder 50 in its fully contracted setting as shown in FIGS. 3, 8A and 8B, the pins are coaxial as shown by the centre line drawn on FIG. 8B and thus the ladder may hinge about the axes of the pins without the platform moving relative to the chassis 10.

Also shown in FIG. 5 is a strut 59 to impart lateral stability to the platform, when raised. The strut will be discussed in further detail with reference to FIGS. 13 to 15 below.

FIGS. 8A, 8B and 9A to 9E show an automatically-operating lock mechanism co-operable with the rungs 56 of the intermediate 53 and second 52 sections of the ladder 50. Such a lock mechanism is provided on both sides of the ladder, on the inwardly directed faces of the respective rails. Each lock comprises a generally triangular plate 62 pivoted at its apex to the intermediate section and including a throat 63 defined by an arm 64. Pivoted to the free end of the arm is a finger 65, restricted to move between the positions shown in FIGS. 8 and 9E respectively, the finger 65 closing the throat 63 when in the position of FIG. 9E.

The sequence of operation of one of the lock mechanisms is shown in the Figures referred to above. The starting position is as shown in FIG. 8, with two rungs accommodated in the throat. On raising the ladder, one rung comes clear of the throat (FIG. 9A) and the plate 62 is pivoted by the next rung up the ladder. On passing that rung, the plate swings back so that the next rung enters the throat 63 and if then the ladder is lowered, the plate will serve to lock the two sections of the ladder and prevent further contraction. If now the ladder is raised again, to take finger 65 past the rung which was entered in the throat 63 (FIGS. 9C and 9D), on attempting to lower the ladder, that rung will push the finger 65 round to close the throat 63. Then, the ladder may be contracted back to its original position. Of course, in practice the ladder will normally be raised much higher than just to a setting where the next rung from the initial position enters the throat, as shown in the drawings, but the sequence of operation will be the same.

Figure 10:
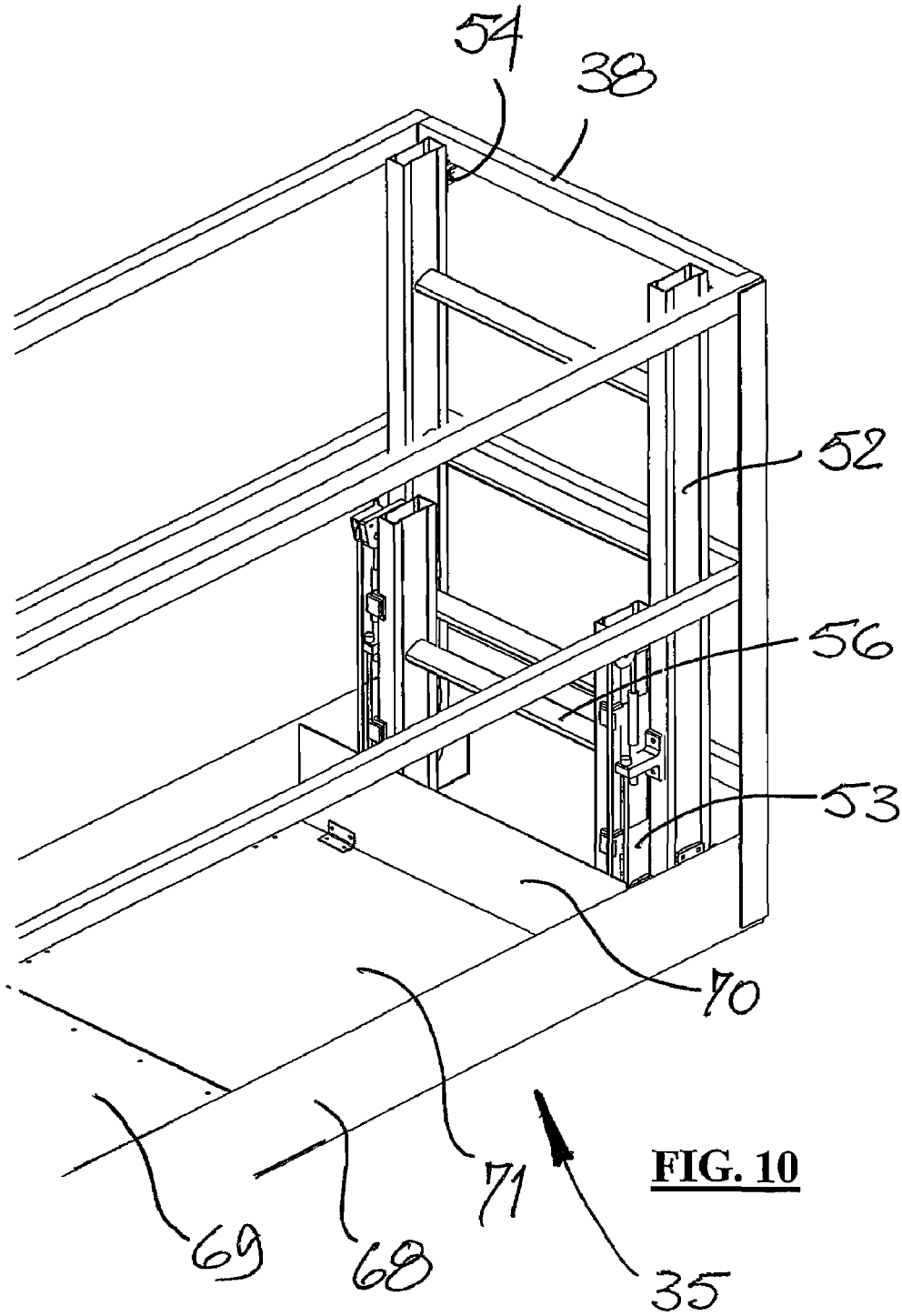
FIG. 10 is a detail view on part of the platform and ladder.
Figure 11:
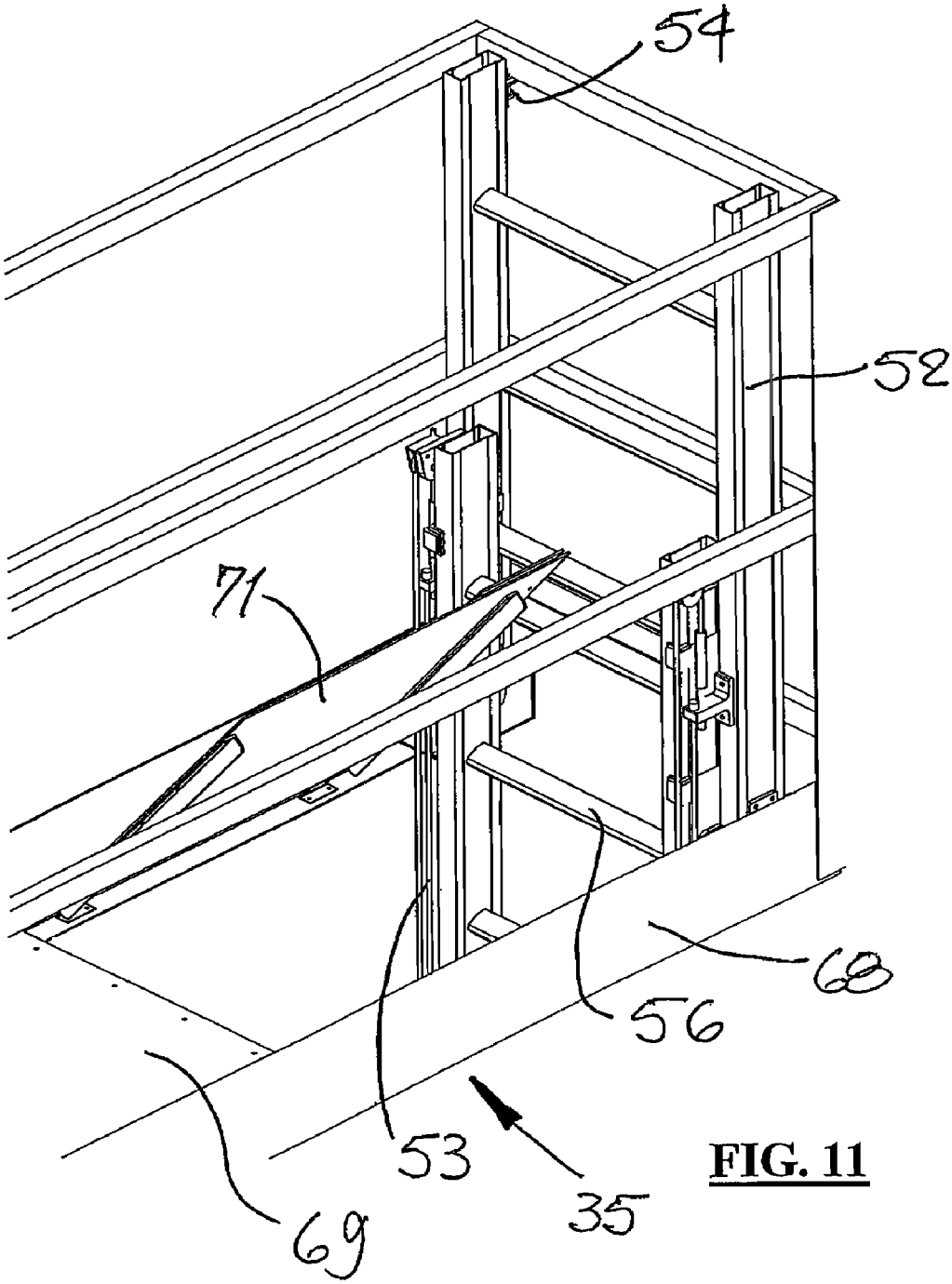
FIG. 11 is a view similar to that of FIG. 10 but with the platform trapdoor raised.

As shown in FIGS. 10 and 11, the platform 35 includes a kickboard 68 around its periphery. Further, the base 69 of the platform includes a movable kickboard 70, which may be hinged between the position shown in FIG. 10 and that shown in FIG. 11. The movable kickboard 70 is mounted on a trapdoor 71 hinged to the platform along a side edge, whereby the trapdoor may be raised to the position shown in FIG. 11, to permit access to the platform from the side of the ladder 50 facing the column 26, when raised.

Figure 12:
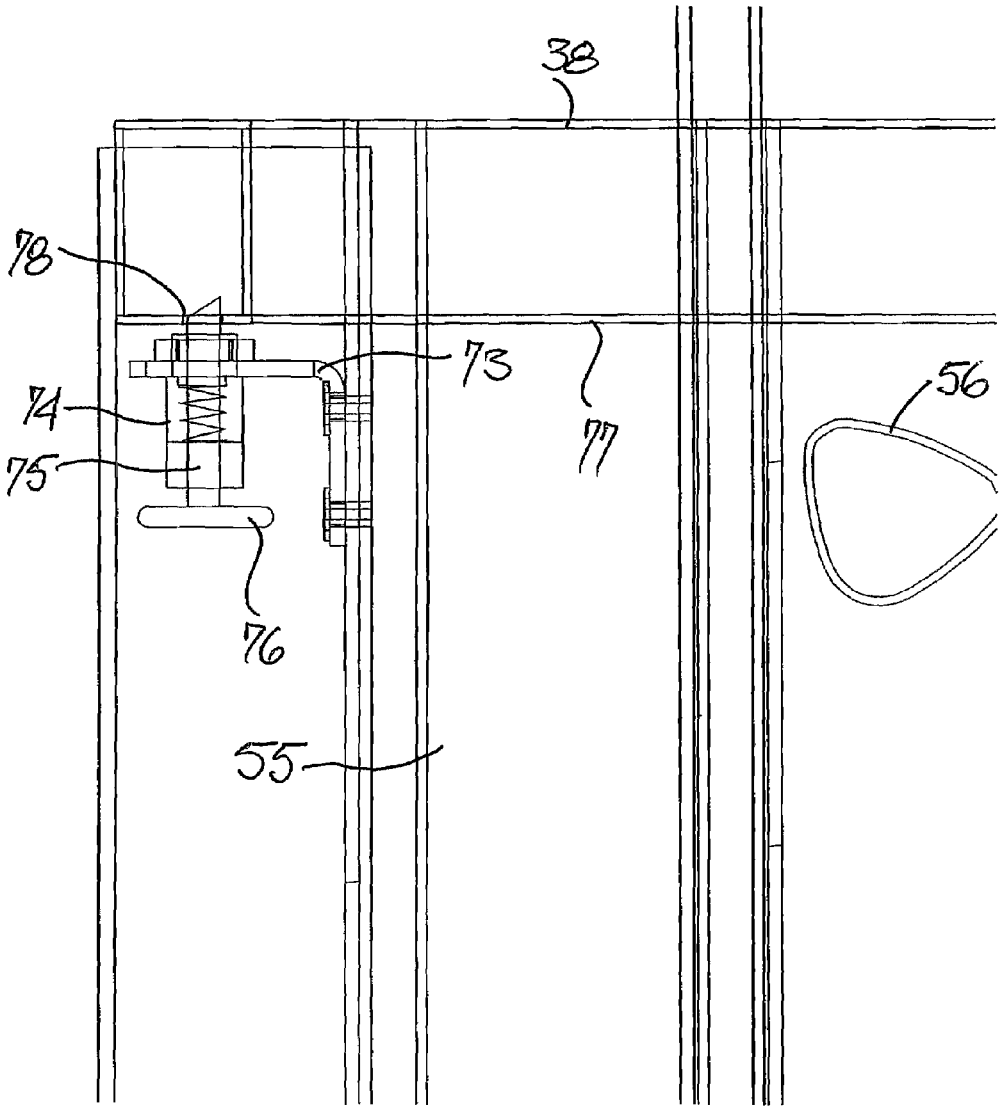
FIG. 12 is a detail view on the interconnection of the ladder and the platform guardrail.

FIG. 12 shows one of the two catch arrangements 54 acting between each rail of the second section 52 of the ladder 50 and the guard rail 38 extending across the rear of the platform. Each catch arrangement 54 comprises an angle bracket 73 riveted to the respective rail 55 of the ladder 50 and supporting a housing 74 in which is mounted a spring-loaded plunger 75 chamfered at its upper end and having an enlarged head 76 at its lower end. The lower face 77 of the guard rail 38 has a simple aperture 78 in which the plunger 75 is receivable, the chamfer allowing the plunger automatically to engage in that aperture. Release is performed by pulling downwardly on the head 76 of the plunger 75, against the action of the spring.

In use, the tower is moved from place to place when in the setting of FIG. 1. Once maneuvered to the required location for use, the tow bar jack 23 is lowered, the outriggers 16,17 are extended and the respective jacks 18,19 are lowered to stabilise the chassis 10. The provision of the castor wheels facilitate fine adjustment in the position of the chassis, by just raising the forward jacks 18.

Once positioned, the ladder 50 is raised to the position shown in FIG. 3 and then the winch 39 is operated to raise the column 26. This lifts the platform 35, which in turn extends the ladder 50. The platform is raised slightly higher than the required final height setting and then is lowered so as to allow the plates 62 of the two lock mechanisms to lock together the sections of the ladder. Thereafter, access may be gained to the platform by climbing up the ladder and through the trapdoor 71.

When the tower is no longer required for use, the platform 35 may be lowered by initially raising the platform slightly to release the lock mechanisms, and then paying out cable from the winch 39 so allowing both the column 26 and the ladder 50 to contract back to their initial positions. When fully contracted, the pivotal axis of the first section 51 of the ladder to the chassis 10 is coaxial with the pivotal axis of the second ladder section 52 to the platform and so the ladder may be pivoted to the position shown in FIGS. 1 and 2, with the upper ends of the ladder rails 55 disposed to each side of the column 26. After connecting the tow bar to a vehicle and raising the jacks 18,19 and 23, the tower may be towed to another site. When being towed, the road wheels 11 should be in their extended positions for stability but may be moved to their narrow setting to minimise the overall width of the chassis, for example to permit the chassis to be wheeled through a narrow entrance or a doorway.

Figure 13:
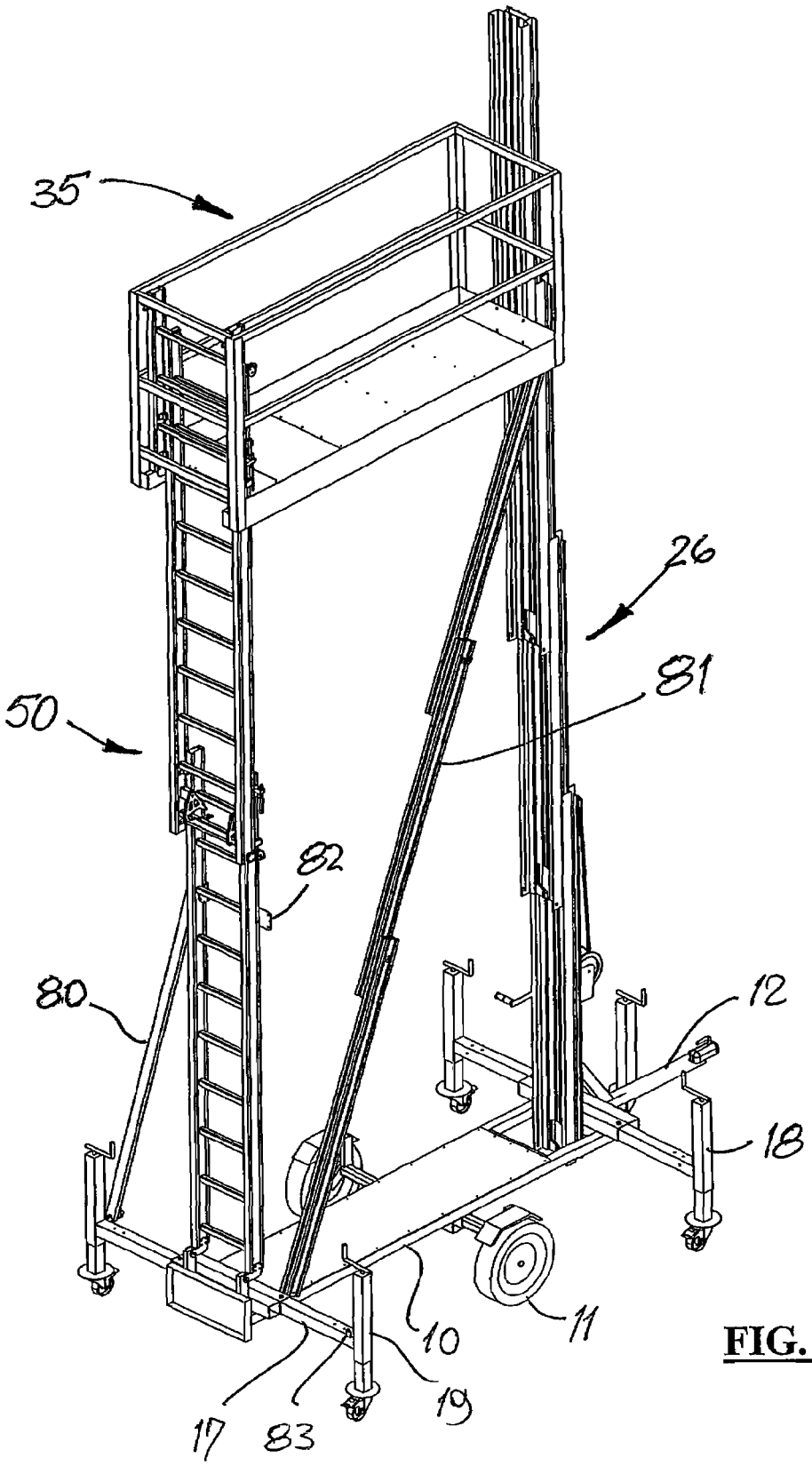
FIG. 13 shows a modified form of the access tower, fully raised.
Figure 14:
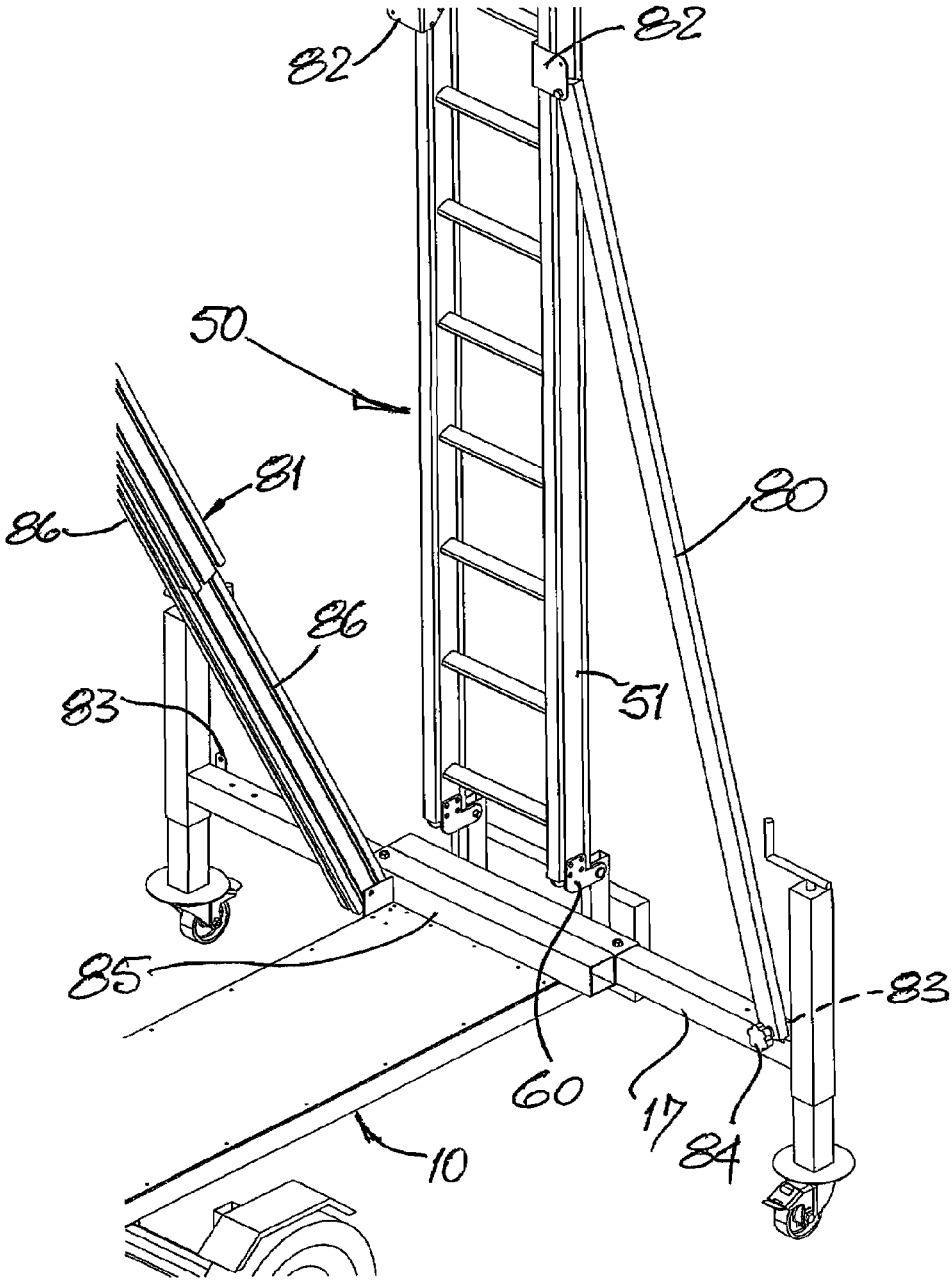
FIG. 14 is a detail view on part of the raised tower of FIG. 13.
Figure 15:
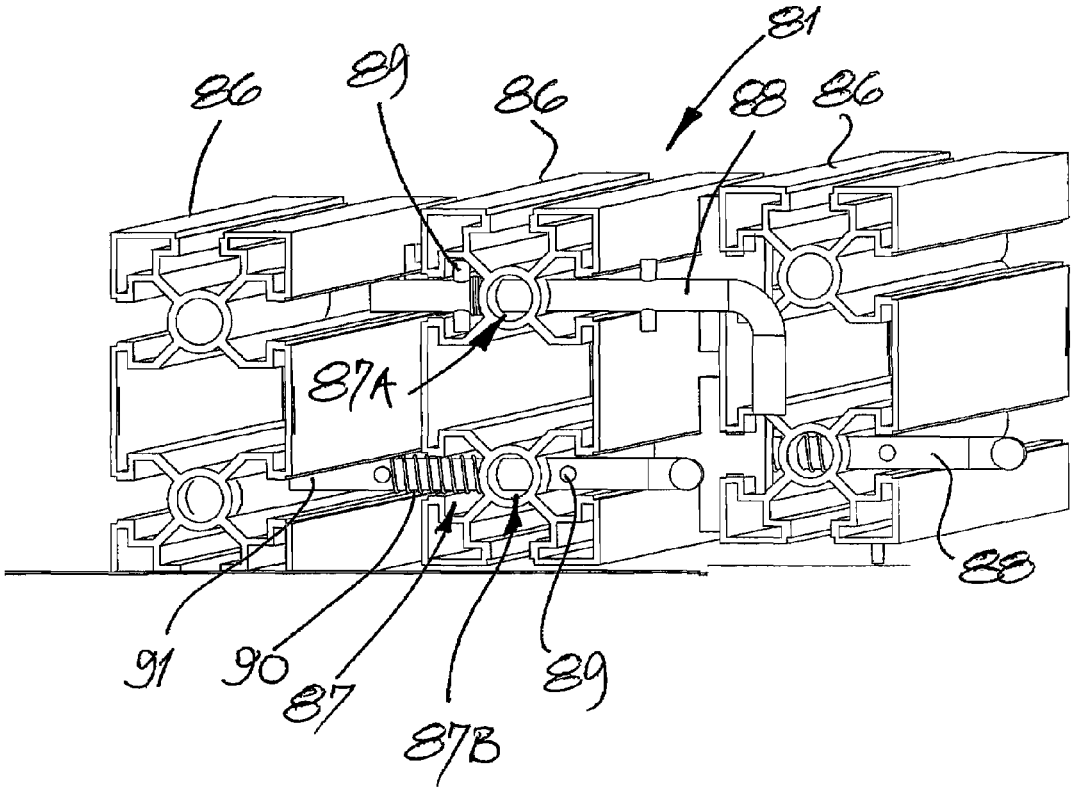
FIG. 15 is a detail view on a catch arrangement employed with the modified form of access tower.

FIGS. 13 to 15 show a modified form of the access tower which includes a fixed length strut 80 (corresponding to strut 59 shown in FIG. 5) and an extensible strut 81. The strut 80 is pivoted at its upper end to a bracket 82 and is releasably connected at its lower end to a further bracket 83 provided on one of the rearward outriggers 17. A bolt having an enlarged head 84 is provided to facilitate the attachment and detachment of the strut 80 from the bracket 83 so that when the access tower is to be collapsed, the strut 83 may be hinged to lie alongside the ladder 50, before the ladder is hinged to its stowed position shown in FIG. 1. A corresponding pair of brackets 82,83 is provided on the other side of the ladder, in order that the strut 80 may be rigged on the other side, or a pair of struts provided to impart yet further stability in the lateral direction.

The extensible strut 81 is hinged at its lower end to a rearward cross-member 85 of the chassis 10 and at its upper end to a forward cross-member of the platform 35. The strut 81 comprises three extruded sections 86 having the cross-sectional profile shown in FIG. 15, which allows the sections to be interlinked for relative sliding movement. Catches 87 are provided to allow respective pairs of sections to be locked together. Each catch 87 comprises a J-shaped pin 88 extending through a bore provided internally within the section 86 mounting the pin, there being cross-bars 89 provided in the pin to each side of the bore inner section. A spring 90 acts between the section and one of the bars to urge forward end 91 of the pin to project from the section, as shown with catch 87A, into a selected hole formed in the adjacent section. The pin may be withdrawn against the action of the spring and then turned through 900 as shown with catch 87B, thereby locking the pin in its withdrawn position and permitting relative sliding movement between the sections.

In use, all of the catches 87 are pulled to their withdrawn positions and the platform 35 is at least partly raised. The strut 80 is hinged out and connected to the further bracket 83, to give lateral stability to the partly raised tower. As the tower is raised to the required working height, the sections 86 of the strut 81 slide relatively and then all of the catches 87 are released so that the respective pins 88 are spring-urged into the adjacent section. Minor movement of the assembly allows the pins to enter corresponding holes in the adjacent sections and so lock the strut, to impart stability in the lengthwise direction of the chassis.

The invention claimed is:

1. A collapsible access tower comprising a base, extensible first and second members mounted on the base and each member being extendible from a contracted setting to a raised setting, the first member being fixedly mounted on the base at a first location to project upwardly therefrom, the second member has a lower end and a pivotal connection between said lower end and the base whereby the second member can pivot about a pivotal axis disposed at a second location spaced from said first location between an erect position at which the second member is extendible upwardly and a transit position where the effective height of the second member is reduced, and a support secured to the first member and pivoted to the second member about a further axis, said pivotal axis and said further axis being substantially coaxial when the first and second members are in their respective contracted settings, whereby the support remains stationary relative to the base when the second member is pivoted between the erect and transit positions.

2. A collapsible access tower as claimed in claim 1, wherein the first and second members each comprises a plurality of sections connected together for relative sliding movement.

3. A collapsible access tower as claimed in claim 2, wherein the first member has a first section rigidly mounted to the base, a second section rigidly connected to the support, and at least one intermediate section slidably linked to the sections to each side thereof.

4. A collapsible access tower as claimed in claim 3, wherein the first member has three intermediate sections.

5. A collapsible access tower as claimed in claim 2, wherein the first member is provided with a hoist arranged to extend the first member, said hoist being arranged also to control collapsing movement of the first member to its contracted setting.

6. A collapsible access tower as claimed in claim 5, wherein the hoist comprises a winch assembly mounted on one of the first section of the first member and the base, and a flexible tension member extending from the winch assembly over a pulley at the upper end of the first section and arranged to raise the adjacent intermediate section.

7. A collapsible access tower as claimed in claim 6, wherein the flexible tension member is secured to a lower part of the intermediate section and a further flexible tension member passes over a pulley at the upper end or the intermediate section to interconnect that section with the next adjacent section.

8. A collapsible access tower as claimed in claim 4, wherein a single flexible tension member passes around pulleys at each end of each intermediate section and is secured to the lower end of the second section, thereby to interconnect all of the sections and permit simultaneous raising of all of the sections.

9. A collapsible access tower as claimed in claim 2, wherein the second member has a first section pivoted about said pivotal axis which extends transversely to the base, a second section pivotally connected to the support about said further axis, and at least one intermediate section slidably linked to the sections to each side thereof.

10. A collapsible access tower as claimed in claim 8, wherein the second section of the second member has a latch arrangement adapted to connect to a part of the support when the second member is in its erect position.

11. A collapsible access tower as claimed in claim 8, wherein the support has a raised guard-rail therearound and the latch arrangement connects to the guard rail.

12. A collapsible access tower as claimed in claim 2, wherein each section of the second extensible member comprises a pair of rails with cross-members extending rigidly therebetween.

13. A collapsible access tower as claimed in claim 11, wherein the spacing of the rails of the second member is greater than the transverse width of the first member whereby the first member may be accommodated between the rails of the second member when pivoted to its transit position.

14. A collapsible access tower as claimed in claim 1, wherein the support comprises one of a platform and a frame on which a support surface is mounted.

15. A collapsible access tower as claimed in claim 1, wherein at least one of the first and second members is provided with an automatically operating lock mechanism restricting collapsing movement of the respective member once extended, until the lock mechanism has been released.

16. A collapsible access tower as claimed in claim 1, wherein the base is arranged as a wheeled chassis supporting the first and second members.

17. A collapsible access tower as claimed in claim 14, wherein the wheels of the chassis are mounted on extendible supports, whereby the track of the chassis may be increased for transit and reduced to minimise the width of the chassis.

18. A collapsible access tower as claimed in claim 1, wherein a removable strut is provided between one of the first and second members and the base to give lateral stability to the tower, when in a raised setting.

19. A collapsible access tower as claimed in claim 1, wherein an extendible strut is provided between one of the first and second members and the base to give longitudinal stability to the tower, when in a raised setting.

20. A collapsible access tower as claimed in claim 1, wherein the support is a platform provided with an openable trapdoor adjacent the second member whereby access to the platform may be reached through the trapdoor when the first and second extensible members have been extended.

* * * * *